US005870109A

United States Patent [19]

McCormack et al.

[11] Patent Number: 5,870,109

[45] Date of Patent: Feb. 9, 1999

[54] GRAPHIC SYSTEM WITH READ/WRITE OVERLAP DETECTOR

[75] Inventors: Joel J. McCormack, Boulder, Colo.; Christopher C. Gianos, Sterling, Mass.; Andrew V. Hoar, Wilton, N.H.; Larry D. Seiler, Boylston, Mass.; Norman P. Jouppi, Palo Alto, Calif.; James T. Claffey, Groton, Mass.

[73] Assignee: Digital Equipment Corporation, Maynard, Mass.

[21] Appl. No.: 870,482

[22] Filed: Jun. 6, 1997

[51] Int. Cl.[6] ..... G09G 5/36

[52] U.S. Cl. ..... 345/515; 345/521

[58] Field of Search ..... 345/191, 509, 345/515, 521, 523–525; 711/1, 212, 3

[56] References Cited

U.S. PATENT DOCUMENTS

| | | | |
|---|---|---|---|
| 5,502,825 | 3/1996 | Nishimukai et al. | 711/3 |
| 5,706,482 | 1/1998 | Matsushima et al. | 345/521 |
| 5,742,796 | 4/1998 | Huxley | 345/509 |

*Primary Examiner*—Kee M. Tung

[57] ABSTRACT

A graphics system for storing and editing graphic images represented by digital data, includes a frame memory for storing pixel data representing graphic images including first and second graphic objects. The pixel data is stored at addresses, each being associated with one or more graphic fragment forming the first and second graphic objects. First and second addresses are respectively associated with those of the graphic fragments forming the first and second graphic objects. A memory controller controls writing and reading the pixel data to and from the frame memory. A fragment editor is provided to receive the pixel data read from the first address and modify the associated fragment with the received pixel data so as to form modified pixel data. An address detector detects the first address responsive to a request to read the pixel data from the first address and the second address responsive to a subsequent request to read pixel data from the second address. The detector compares the detected first and second addresses to identify an overlap of the first and second graphic objects. If an overlap is identified, the controller controls the writing of the modified pixel data to the first address before the reading of the pixel data from the second address.

23 Claims, 4 Drawing Sheets

205

| | | | | | | |
|---|---|---|---|---|---|---|
| A | B' | C | D' | E | F' | G |
| H' | I | J' | K | L' | M | N' |
| O | P' | Q | R' | S | T' | U |
| V' | W | X' | Y | Z' | AA | BB' |

FIG. 2

205

| | | | | | |
|---|---|---|---|---|---|
| A | B' | C" | D''' | E | F' |
| G" | H''' | I | J' | K" | L''' |
| M | N' | O" | P''' | Q | R' |
| S" | T''' | U | V' | W" | X''' |

FIG. 3

| | | | |
|---|---|---|---|
| A-1 | A-2 | A-3 | A-4 |
| A-5 | A-6 | A-7 | A-8 |
| A-9 | A-10 | A-11 | A-12 |
| A-13 | A-14 | A-15 | A-16 |
| A-17 | A-18 | A-19 | A-20 |

| | | | |
|---|---|---|---|
| B'-1 | B'-2 | B'-3 | B'-4 |
| B'-5 | B'-6 | B'-7 | B'-8 |
| B'-9 | B'-10 | B'-11 | B'-12 |
| B'-13 | B'-14 | B'-15 | B'-16 |
| B'-17 | B'-18 | B'-19 | B'-20 |

FIG. 4

235

530 510 520

| ENTRIES | ADDRESS TAG & COMPARITOR | DATA |
|---|---|---|
| 1 | N-BITS | 4-BITS |
| 2 | • | • |
| 3 | • | • |
| 4 | • | • |
| 5 | • | • |
| 6 | • | • |
| 7 | • | • |
| 8 | • | • |
| 9 | • | • |
| 10 | • | • |
| m | • | • |

FIG. 5

GRAPHIC SYSTEM WITH READ/WRITE OVERLAP DETECTOR

TECHNICAL FIELD

The present invention relates to graphic systems and more particularly to detection of overlapping pixels in reading and writing digital data.

BACKGROUND ART

Graphics operations typically require a read, modify, write operation. For example, in source/destination blending, a translucent surface is rendered by reading the solid surface color from the frame buffer memory and then arithmetically blending with the translucent color. The blended result is then written back to the same location in the frame buffer. In plane masking, a bit mask is used such that only specified bits of a pixel are overwritten by new data; in general this requires reading the destination, merging new data and writing the result. In Z buffering, hidden surface removal is accomplished by reading the destination Z value and then arithmetically comparing the destination Z value to a source Z value to determine acceptability before conditionally writing back the source Z value to the frame buffer.

A read/write turn-around typically involves switching the frame buffer memory bus from reading data to writing data, and then to back to reading data. This results in a latency or delay between issuing a request to read data from a particular address to actually receiving the data from the frame memory. Similarly, once data is to be written back to the frame memory, the frame buffer memory bus must be switched from read to write and accordingly another latency or delay may be experienced as the bus is put in high impedance mode for one or more cycles. These delays can be significant.

To reduce the impact of these latencies, it has been proposed that a number of reads and writes be batched together to decrease the number of read/write turnarounds. The actual length of the batch of reads or writes is limited only by the system's physical hardware.

However, if multiple graphical objects are rendered, there may be a complete or partial overlap of one object with another object. For example, one object may be "in front of" another object when viewed. This may create a consistency problem for batching in that if a first object has yet to be written to the frame memory, then reads for a second overlapping object could use the old, i.e., unmodified data, from the frame buffer. This is an unacceptable error.

For example, in a system having a single pixel at each address, let us say that a single pixel is read during each read cycle and a single pixel is written during each write cycle. Let us assume that the first four pixels being read are associated with one object and the next four pixels being read are associated with another object and the fourth and seventh read pixels are at identical pixel addresses. If the pixel data read at the fourth address has been modified but is yet to be written back to the frame buffer, the pixel data read at the seventh address will be read from erroneous stale data in the frame buffer rather than the modified pixel data.

To solve this problem, graphic systems often prohibit batching reads for one object with reads for another object. Accordingly, all reads and writes for one object are processed before reading any pixel data for another object, to completely avoid the consistency problem. However in modern graphic systems, graphical applications are using smaller and smaller objects to reduce artifacts when rendering curved surfaces and the read/write turnaround penalty is getting proportionally larger with each new generation of memory. Thus, to require a complete writing of a first object before reads for a subsequent object can result in a significant system overhead and unacceptable delays.

Simple techniques have been proposed to detect overlaps in graphic images. One technique proposes comparing the minimal bounding rectangles of respective objects to detect an overlap. However, this technique tends to result in a high false-positive rate and is generally considered to be of little practical use. More sophisticated techniques have been proposed which require extensive computation to determine if respective objects are overlapping. Such techniques are computationally expensive and made even more so because the comparison is not simply of two successive objects, but rather of multiple successive objects.

It has also been proposed to use a cache for the frame buffer memory in combination with rather complex bookkeeping to track dependencies created by overlaps. By utilizing an out-of-order implementation, overlapping objects could be painted faster than non-overlapping objects, in many cases, by avoiding the writing and rereading for an overlapped object in the frame memory prior to reuse of the overlapped pixel data. Instead, the overlapped pixel data can be read directly from the cache and hence read in its current, e.g. modified, form. However, such cache memory requires extensive resources and expense.

OBJECTIVES OF THE INVENTION

Accordingly, it is an objective of the present invention to provide a technique for providing correct graphic imaging with enhanced efficiency.

It is a further object of the present invention to provide a technique which efficiently avoids graphic image overlap error in digital graphic imaging.

It is another object of the present invention to provide a technique which correctly renders overlapped objects without requiring that all previously read pixel data associated with one graphic object be rewritten into the frame memory prior to each read of pixel data associated with another graphic object.

Additional objects, advantages, novel features of the present invention will become apparent to those skilled in the art from this disclosure, including the following detailed description, as well as by practice of the invention. While the invention is described below with reference to preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY DISCLOSURE OF THE INVENTION

The present invention provides a graphics system for storing, creating and modifying graphic images represented by digital data. The system includes a frame memory, such as a buffer memory, to store pixel data representing graphic images having a first and second graphic object. The frame memory may, for example, be a synchronous dynamic random access memory (SDRAM) or other suitable memory storage devices. The frame buffer memory can, if desired, be fully within a single graphic controller, but will more typically be partitioned between multiple graphic controllers. The respective graphic objects could be any type of graphic whatsoever.

The pixel data are stored at a plurality of addresses of the frame memory. Each of the addresses is associated with one or more of a plurality of graphic fragments forming the first and second graphic objects. Each graphic fragment forms a portion of one graphic object. A first set of the addresses is associated with the graphic fragments forming the first graphic object and a second set of the addresses is associated with the graphic fragments forming the second graphic object.

A memory controller controls writing of the pixel data to the frame memory, and reading of the pixel data stored in the frame memory. A fragment editor, which may for example be in the form of a test/blend pipeline, receives pixel data read from the first set of addresses and modifies the associated fragment with the received pixel data so as to form modified pixel data associated with the first graphic object.

An overlap detector, preferably implemented as a content addressable memory (CAM), detects the first address responsive to the request to read the pixel data from the first address, and also detects the second address responsive to a subsequent request for the memory controller to read pixel data from the second address. The CAM detector will beneficially include an address memory, for storing the detected addresses. The detector compares the detected first and second addresses to identify any overlap of the first graphic object and the second graphic object. If an overlap is identified, the controller controls the writing and reading of the pixel data such that the modified pixel data are written to the first address of the frame memory before pixel data are read from the second address of the frame memory at which modified pixel data are written. Hence, any modified pixel data associated with the overlap are updated in de frame memory before being read out from the second address. The memory controller and fragment detector are typically all part of a graphics controller which may advantageously be formed on a graphics accelerator chip.

Each of the plurality of addresses is preferably formed of first bits, which will be ignored by the detector, having a first bit length and second bits, which will be used by the detector, having a second bit length. The sum of the first and second bit lengths will typically equal the total bit length of an address. Beneficially, the detector detects and compares only the second bits of addresses forming the first and second addresses to identify an overlap of the first and second graphic objects. Preferably the first bit length, i.e., the length of the ignored bits, is greater than the second bit length, i.e., the length of the detected bits, and therefore only relative short bit lengths need be compared to identify an overlap. It will be understood by those skilled in the art that ignoring any number of address bits is beneficial from an overhead standpoint. However, it should be recognized that ignoring an excessive number of address bits could result in an unacceptable level of false overlap detection and bus turnaround overhead.

It may be convenient, for example when SDRAM is utilized for the frame memory, to store different pages of graphic images in different memory storage banks, e.g. in different SDRAM's or in different banks of a single SDRAM. The portion of the address which is used by the detector, beneficially contains this bank information.

In accordance with certain aspects of the invention, the address memory is cleared of the detected first address, as well as all other addresses stored in the detector, responsive to the detector detecting a request to read overlapping pixel data associated with the second address. Further, if the first and second addresses are associated with a first page of graphic images, the first, second and all other addresses stored on the detector may advantageously be cleared responsive to the detector detecting a request to read pixel data associated with another page of the graphic images.

In accordance with other aspects of the invention, the pipeline from the read queue is cleared responsive to the memory controller identifying a request to read overlapping pixel data or pixel data associated with another page of the graphic images.

BRIEF DESCRIPTION OF DRAWINGS

FIG. 2 depicts a first configuration of frame memory storage banks of the FIG. 1 memory storing pixels associated with respective pages.

FIG. 3 depicts a second configuration of memory banks of the frame memory of FIG. 1.

FIG. 4 depicts individual pixel addresses for pixels associated with graphic images on separate pages.

FIG. 5 depicts a preferred embodiment of the overlap detector of FIG. 1.

BEST MODE FOR CARRYING OUT THE INVENTION

Figure 1:
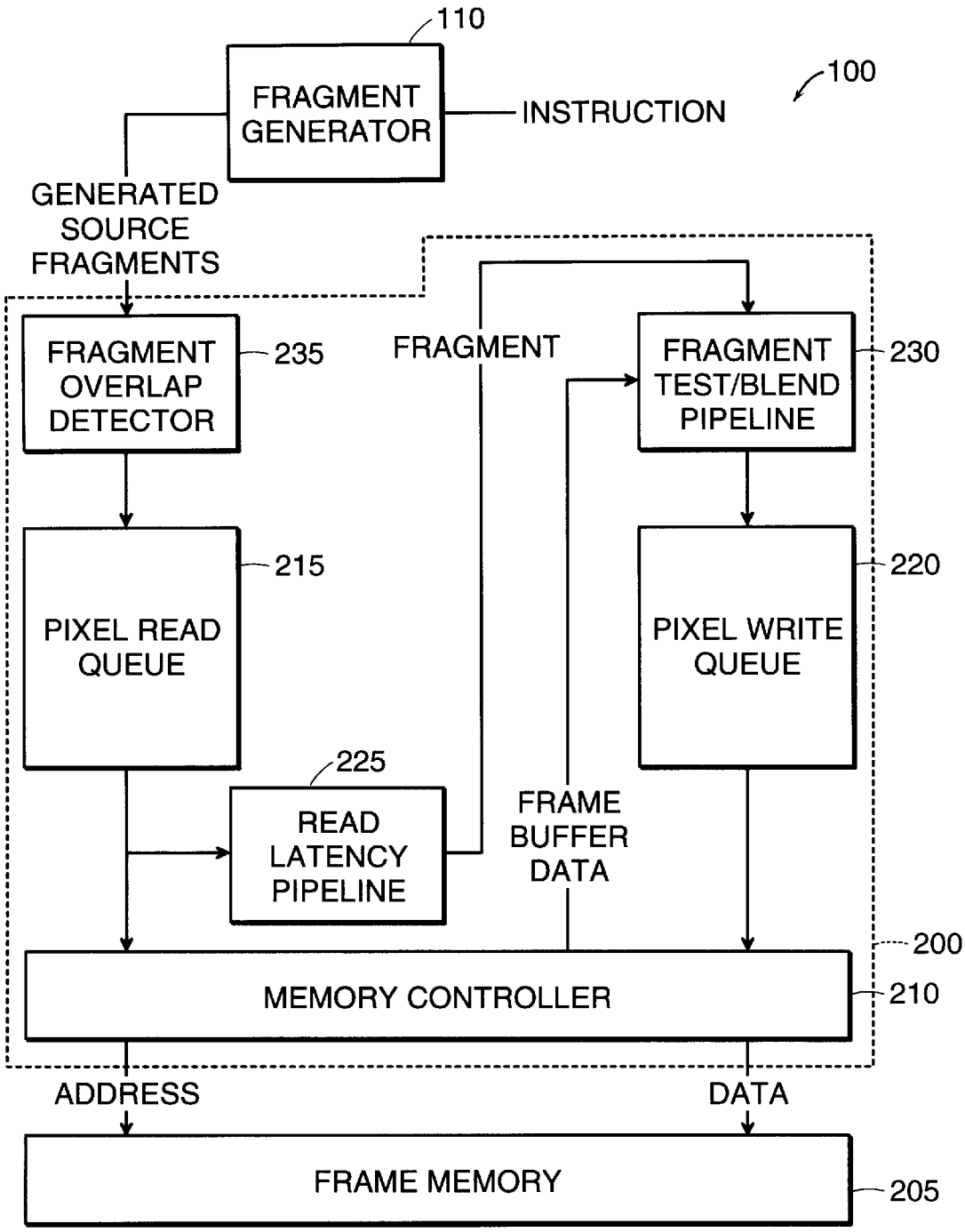
FIG. 1 depicts a simplified block diagram of a portion of a digital graphics system.

FIG. 1 depicts a simplified block diagram of a graphic system 100 which includes a fragment generator 110 for providing fragments to the graphic controller 200. The generator 110 is, as shown, interconnected to the graphic controller 200 so that fragments can be utilized to create or modify graphic images. The graphic controller 200 includes a fragment test/blend pipeline 230 which serves as an editor for modifying graphic images. The graphics controller 200 also controls the storage and retrieval of digital pixel data representing the graphic images, including pixel data modified by a fragment test/blend pipeline 230. It should be understood that the graphic system, if desired, could include multiple controllers 200. Such multiple controllers may have entirely separate or shared components, as may be appropriate.

The graphic system 100 includes a frame buffer memory 205 which is preferably formed of SDRAM which is controlled by a memory controller 210. The graphics controller 200 includes a memory controller 210 which receives requests to read pixel data from the frame memory 205 via the pixel read queue 215. Such requests will typically be generated by the fragment generator 110. The memory controller 210 also receives requests to write pixel data into the frame memory 205 via the pixel write queue 220. Requests to write pixel data into the frame memory 205 are received from the fragment test/blend pipeline 230. The pixel data to be written may be newly created pixel data, in which case no pixel data need be read from the memory before writing pixel data into the memory at the desired address. The pixel data to be written may include pixel data which has been read from the frame memory and modified in the fragment test/blend pipeline 230. The pixel data to be written may also include pixel data which has been read from the frame memory and passed through the fragment test/blend pipeline 230 without modification.

The graphics controller 200 also includes a read latency pipeline 225 which cooperates with the fragment test/blend pipeline 230, in a manner which will be further detailed below, to properly synchronize fragments with the associated pixel data read from the frame buffer memory 205. A fragment overlap detector 235 is further provided for detecting overlapping fragments associated with the objects forming the graphic image in accordance with the present invention.

Graphic objects, such as triangles, lines, or rectangles are typically divided into atomic units called "fragments". These graphic objects make up graphic images which may be formed on one or more memory pages in the frame buffer memory 205. Each fragment contains all the source information relating to one pixel of the associated object which is necessary to create or modify that pixel of the object. Typically, a fragment includes the address in the frame buffer at which the pixel data are or will be stored. The fragment also includes RGB color data to replace or blend with the frame buffer memory 205 RGB information. The fragment may also include a byte mask for the RGB color data. Alpha intensity data necessary in blend operations is also normally included. The fragment also will generally include Z depth information to be compared against the Z depth information stored in the frame buffer memory 205.

The frame memory 205 is preferably configured as shown in FIG. 2 or FIG. 3. FIG. 2 depicts a storage configuration in which graphic images on respective pages A–BB' are stored in respective portions of the memory which are configured as two banks. Those portions of the memory making up the first bank are depicted without a prime, e.g., A, C, E and G. Those areas of the frame buffer memory 205 forming the second bank are designated with a prime, e.g., B', D', F' and H'. In the FIG. 3 configuration, the frame buffer memory 205 is divided into four banks. Those areas of the frame memory 205 which form the latter two banks are respectively designated with a double-prime and a triple-prime.

As shown in FIG. 4, each pixel represents a portion of the graphic image on a particular memory page. Pixel data for those objects forming graphic images on page A are stored at an address, i.e., A-1, A-2, A-3, etc., corresponding to page A and pixel data for those objects forming graphic images on page B are stored at addresses, e.g., B'-1, B'-2, B'-3, etc., corresponding to page B. Each of the respective addresses, A-1, B'-1, etc., have a physical address length which may be substantial, e.g., 20 bits or more. Because the pixel addresses are mapped onto a SDRAM page containing a rectangular area that is as close as possible to square, and the addressees for the respective pages associated with the different banks are arranged in a checkerboard format, the horizontal or vertical transition from one page to another will also transition from one bank to another as shown in FIGS. 2 and 3. Additionally, it should be noted that in the four bank configuration shown in FIG. 3, the diagonal transition from one page to another will also transition from one bank to another.

Referring again to FIG. 1, the operation of the graphic system 100 will be described. In accordance with operator instructions, the fragment generator 110 generates a fragment including an address of pixel data of a graphic object forming that portion of the graphic image on a particular page, to request the associated digital pixel data from the frame memory 205. The generated source fragment is transmitted to the fragment overlap detector 235.

As shown in FIG. 5, the fragment overlap detector is preferably a M-entry content-addressable memory (CAM). Each of the M-entries 530 has an N-bit address tag with associated comparator 510, plus four bits of data 520. The four bits of data represent one bit for each byte in a 32 bit word. Preferably the CAM is small, with M being from 8 to 12 entries and N being of 9 bits. It is perhaps worthwhile noting here that graphic system 100 has a data path of 32 bits so that one 32-bit pixel or four 8-bit pixels can be packed in each physical word, hence the use of four data bits 520 which are set in the CAM using the four byte mask bits of the fragment.

The fragment overlap detector 235 compares the N-bit portion of the frame buffer address of the requested pixel data with the N-bit portion of previously transmitted fragment frame buffer addresses and, if the N-bit portions match, then compares the associated 4 bits of data 520 to the four byte mask bits of the subject fragment to determine if any set bits, i.e., one-bits, of the data 520 match a set bit of the four byte mask bits. The detector 235 can thereby identify an overlap between the previously requested and presently requested fragments. Preferably the fragment is marked with a special overlap barrier if a match is detected. However, whether or not the incoming fragment overlaps a previously requested fragment, it is written to the end of the pixel read queue 215. The pixel read queue contains requests to read Z, stencil, and/or color data from the frame buffer memory 205. The pixel read queue 215 is serviced by the memory controller 210 which forwards each fragment address from the pixel read queue 215 to the frame memory 205, and retrieves the pixel data from the fragment address of frame memory 205.

The read latency pipeline 225 holds the fragment for the period it takes the memory controller 210 to access the pixel read queue 215 and the frame memory 205, and to deliver the requested pixel data from the frame memory 205. The pixel data read from the frame memory 205 along with the associated fragment from the read latency pipeline 225 are transmitted in a synchronized manner to the fragment test/blend pipeline 230.

The fragment test/blend pipeline 230 compares the fragment's Z and stencil values against similar data from the frame buffer memory 205. As will be understood by those skilled in the art, if the test fails the fragment is typically discarded. If the test is satisfactory, the fragment's color information is blended with the retrieved pixel data color information, if any, and forwarded to the write queue 220. The pixel write queue contains requests to write Z, stencil and/or color data to the frame buffer memory 205. When the memory controller 210 services the pixel write queue 220, it sends the retrieved fragment address to the frame memory 205 along with Z, stencil and/or color data, as applicable.

As will be understood by those skilled in the art, memory controllers, such as memory controller 210, typically utilize heuristic algorithms and some absolute constraints to select between servicing requests in the pixel read queue 215, pixel write queue 220, and certain other queues (not shown). The other queues are unrelated to the present invention and therefore will not be further described herein. If the pixel read queue is full and the pixel write queue is not empty, a heuristic decision may determine whether to service the pixel read queue 215 or pixel write queue 220 in the next cycle. Further, the memory controller 210 may have absolute constraints such that if both the pixel write queue 220 and the fragment test/blend pipeline 230 are full the controller 210 must service the pixel write queue 220 prior to servicing a read pixel queue 215 which is not empty. This is because the pixel read queue typically cannot be serviced when there is no room in the pixel write queue 220 and the fragment test/blend pipeline 230 to store newly read pixel data. Hence, no further data can be read from the frame memory 205 until space is made available in the fragment test/blend pipeline 230 or the pixel write queue 220. It should be noted that fragment data in the read latency pipeline 225 should generally be considered for determining when the pixel write queue 220 is full.

Also, if the fragment at the head of the pixel read queue is marked with a special overlap barrier flag, then the memory controller 210, in accordance with the present invention, is prohibited from servicing the pixel read queue 215 until the read latency pipeline 225, fragment test/blend pipeline 230, and pixel write queue 220 are completely empty. This latter constraint ensures that overlapping pixel data will not be read from the frame memory 205 until overlapped data which has been previously read and which may have been modified in the fragment test/blend pipeline 230 have been rewritten in their modified form to the frame memory 205.

Accordingly, overlapping pixel data which will be read from an identical address in the frame memory 205 as that of the previously read overlapped data, will be updated in the frame memory 205 before being read responsive to the subsequent request which has moved to the head of the pixel read queue 215. This ensures that overlapping pixels retrieved from the frame buffer 205 reflect all modifications to previously requested overlapped pixels made by the fragment test/blend pipeline 230. Overlap error is thereby eliminated without the need to rewrite pixel data previously read from the frame memory 205 back to frame memory 205 prior to a subsequent read of pixel data from the frame memory 205, except in cases where an overlap is detected. Accordingly, correct results are obtained in overlapping cases, while in non-overlapping cases substantially less read/write turnaround overhead is required since long batch lengths can be utilized.

It should be understood that from time to time the CAM will completely fill during operation of the graphic system 100. Once the CAM has been completely filled, the CAM is completely cleared responsive to receipt of the next fragment by the fragment detector 235. The current fragment N-bit address and four-bit byte mask data are then stored in the CAM. The fragment is also tagged by the detector 235 before forwarding to the pixel read queue 215. When the memory controller 210 finds the tagged fragment at the head of the pixel read queue, it treats this fragment in the same manner as other tagged fragment and clears the pipeline prior to servicing the tagged fragments as has been previously described.

It is also preferable that the number of entries M in the CAM be equal to the length of the pixel write queue 220 plus the length of the fragment test/blend pipeline 230. This, as discussed above, is usually the maximum possible batch length of pixel data that can be read before the memory controller 210 can service the pixel write queue 220. If no fragments are being discarded by the fragment test/blend pipeline 230, then the memory controller 210 will be forced to service a full pixel write queue 220 before servicing the head fragment in the pixel read queue 215. The number of entries (M) in the overlap detector CAM could, if desired, be made greater than the length of the pixel write queue 220 and fragment test/blend pipeline 230. However, this will be very inefficient unless the number of entries M is made substantially greater than the length of the queue 220 and pipeline 230. It will be further understood that the use of an M having a large length may be particularly efficient in cases where there are minimum overlapping images and/or many fragment discards by the pipeline 230.

If an overlap is detected on a 32 bit basis and four 8 bit pixels can be packed in one 32-bit word, depending on how the 8 bit pixels are packed, objects that are near, but not overlapping, may erroneously appear to overlap because they share the same 32-bit address. Accordingly, depending upon the implementation, it may be preferable to detect overlaps on an 8 bit basis by using the fragment's byte masks.

In a typical operational sequence of the graphic system 100 shown in FIG. 1, the initially generated source fragments include requests to access, for example, pixel data associated with a graphic object stored at addresses A-1, A-2, A-3, and A-4. Each fragment's address information which is used, is stored by the CAM detector 235 and the fragment is then forwarded to the pixel read queue 215 and eventually serviced by the memory controller 210 which sequentially reads the pixel data from addresses A-1 through A-4 and forwards the pixel data to the pipeline 230. Each fragment, as discussed above, is held by the read latency pipeline 225 and then tested and blended with the retrieved pixel data in the fragment test/blend pipeline 230 before proceeding to the write queue 220. The fragment test/blend pipeline 230 may modify the fragment with retrieved pixel data to form modified pixel data. In such cases, the modified pixel data is forwarded to the pixel write queue 220. It will be understood that each of the addresses A-1 through A-4 is compared with the addresses stored in the fragment overlap detector 235 at the time the fragment is received by the detector 235. For example, in the present example, the address A-4 will be compared with addresses A-1 through A-3 and any other addresses which have been previously stored by the detector 235. In this example, it is assumed that no overlap is identified in comparing addresses A-1 through A-4 with previous addresses stored in the CAM of the detector 235, in part because the fragments requesting pixel data from addresses A-1 through A-4 form part of the same object. It will of course be recognized that in practice, fragments associated with one object will not necessarily be generated by the fragment generator 110 or received by the fragment overlap detector 235 consecutively and that the graphics controller does not actually associate fragments with specific objects forming graphic images.

Other generated source fragments may request pixel data for another object of the graphic image. These generated source fragments may, for example, request pixel data at addresses A-5, A-6, A-3 and A-7. The fragment overlap detector 235 detects the overlap in the respective objects associated with the requested pixel data by individually comparing each new address, i.e. addresses A-5, A-6, A-3 and A-7, with previous addresses, i.e. addresses A-1 through A-4 etc., which are stored in the CAM.

That is, in the above example, two fragments request pixel data at address A-3 and therefore the objects represented by the respective fragments are overlapping. Accordingly, the fragment overlap detector 235 tags the latter received of the applicable fragments requesting pixel data from address A-3 and transmits it to the end of the pixel read queue 215. More particularly, the fragment overlap detector 235 receives the latter fragment requesting pixel data from address A-3 and compares it to previously detected addresses A-1 through A-6 which have been stored in the CAM. The fragment overlap detector 235 determines that the previously stored and currently requested pixel data address A-3 are the same and thereby identifies that there is an overlap represented by pixel data at addresses A-1 through A-6. The CAM of the overlap detector 235 is cleared of the previously stored addresses A-1 through A-6 and the address A-3 detected in the most recently received fragment is stored in the CAM. The most recently received fragment is also tagged by the fragment overlap detector 235 before forwarding to the end of the pixel read queue 215.

When the memory controller 210 examines the pixel read queue 215 and determines that a tagged fragment is at its head, the memory controller 210, prior to continuing the servicing of the pixel read queue, first services the pixel write queue 220 until the queue 220, and the read latency and fragment test/blend pipelines 225 and 230 are empty. This ensures that any modifications made to pixel data stored at address A-3 in connection with the prior read of the pixel data is rewritten into the frame memory 205 before the memory controller 210 services the current request at the pixel read queue head to read data from address A-3. The memory controller 210 is configured such that the reading of pixel data from address A-3 responsive to the fragment now at the head of the read queue 215 is delayed or stalled until pixel data at all of the previous non-overlapping addresses A-1 through A-6 are rewritten from the pixel write queue 220 to the frame memory 205. Hence the entire pipeline is cleared before actually reading pixel data from the A-3 address of the frame memory 205 responsive to the second fragment being at the head of the read queue 215.

It should be noted that the delay in the read of pixel A-3 could, if desired, be delayed only until pixel data have been rewritten to address A-3 by the memory controller 210, and without waiting until pixel data are rewritten to addresses A-4 through A-6. However, this would modify the simple control of the memory controller 210 and overlap detector 235 at a significant increase in logic complexity.

Thus, if the fragment overlap detector 235 determines that pixel data being requested by the most recently received fragment is at an address which matches an address of a previously received fragment and which is stored in the CAM of the fragment overlap detector 235, the following will occur. The fragment overlap detector 235 will clear the CAM of the previously stored addresses, then store the address detected in the most recently received fragment in the CAM. The fragment overlap detector 235 will also tag the most recently received fragment before forwarding the fragment to the end of the pixel read queue 215. Hence, the memory controller 210 will only service tagged fragments after the originally stored overlapped address in the fragment overlap detector 235 has been cleared from the CAM. The address from the current fragment will remain available in the CAM for detecting an overlap of a subsequently requested object based upon a later transmitted fragment address. The memory controller 210 will delay the reading of pixel data from the address associated with the tagged fragment once it reaches the head of the read queue 215 until all of the previously detected nonoverlapping addresses are rewritten from the pixel write queue 220 to the frame memory 205, that is until the entire pipeline, including the read latency pipeline 225, the fragment test/blend pipeline 230 and the write queue 220, is cleared.

As has been discussed above, the physical addresses within the frame memory 205 are over 20 bits in length. However, only 9 or 10 of these bits are matched by the overlap detector 235 to determine if an overlap exists. In this regard, address comparison can be performed in overlap detector 235 using 8 bits of the column address plus either a single bank bit if the frame memory includes two memory banks or two bank bits if the frame memory includes four memory banks. This is possible with minimum performance impact because of the checkerboard arrangement of the storage of respective pages of the graphic image in the frame memory 205. This ensures that any pair of addresses that are in different banks cannot generate false overlap detection.

However, an overlap can be falsely detected when a series of fragments moves from a page in one bank to another page in the same bank. Moving from one page to another in the same bank is a time consuming operation that takes longer than a read/write turnaround. Accordingly, in accordance with the present invention, instead of reading a batch of pixels that cross from one page to another within a single bank, the memory controller 210 controls the servicing of the queues 215 and 220 such that all read, modify and write operations associated with one page are completed before any reading of pixel data associated with another page in the same bank. Thus, even if the overlap detector 235 falsely detects an overlap, this has no effect on the behavior of the memory controller 210. Since the memory controller 210 behaves as though a new fragment on a different page in the same bank is tagged as an overlapping fragment, in such cases the overlap detector 235 actually tags the new fragment and clears the address memory. Therefore, required processing and storage within the fragment overlap detector 235 can be significantly reduced by simply utilizing some portion of the fragment address bits, e.g. lower bits, and ignoring the remaining portion of the address bits, e.g. higher bits, of the fragment address.

Even when a static RAM (SRAM) is utilized for the frame memory 210, such that all access to the memory is equal, it may still be desirable to use only a portion of the fragment address bits, rather than the full physical memory address, to detect overlaps. For example, by using the lower five bits of the X and Y coordinates of the address, 32×32 squares of pixels can be created. Inside this square, overlap detection is perfect. Though each square is aliased to every other square, the spacial locality of the fragments would minimize the false positives detected due to the aliasing.

Accordingly, it would take at least 32 contiguous fragments to get from one location to an aliased location that would falsely overlap. If the maximum batch size is smaller than this, any contiguous series of fragments will never trigger a false overlap, because the overlap detector will be flash-cleared more frequently than the alias frequency. Although a false overlap could be triggered by rendering two objects at the same location in different 32×32 squares, this, in practice, does not occur often and accordingly should not have a significant impact on performance of the graphic system.

As described above, the present invention provides correct digital graphic imaging with enhanced efficiency. Graphic image overlap error in digital graphic imaging is avoided in a highly efficient manner and without requiring that all previously read pixel data associated with one graphic object of a graphic image be rewritten into the frame memory prior to each read of pixel data associated with another graphic object of the graphic image.

It will also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes, those skilled in the art will recognize that its usefulness is not limited thereto and that the present invention can be beneficially utilized in any number of environments and implementations. Accordingly, the claims set forth below should be construed in view of the full breadth and spirit of the invention as disclosed herein.

We claim:

1. A graphics system for storing and editing graphic images represented by digital data, comprising:

a frame memory configured to store, at a plurality of addresses, pixel data representing graphic images including a first graphic object and a second graphic object, each of the plurality of addresses being associated with one or more of a plurality of graphic fragments forming the first graphic object and the second graphic object, and a first of the plurality of addresses being associated with a first of the plurality of graphic fragments forming the first graphic object and a second of the plurality of addresses being associated with a second of the plurality of graphic fragments forming the second graphic object;

a memory controller configured to control writing of the pixel data to the frame memory, and reading of the pixel data stored in the frame memory;

a fragment editor configured to receive the pixel data read from the first address and to modify the associated fragment with the read pixel data so as to form modified pixel data; and an address detector configured to detect the first address responsive to a request to read the pixel data from the first address, to detect the second address responsive to a subsequent request to read the pixel data from the second address, to compare the detected second address with the detected first address and to identify an overlap of the first graphic object and the second graphic object if the first address and the second address are identical;

wherein, if an overlap is identified, the controller controls the writing and the reading of the pixel data such that the modified pixel data is written to the first address of the frame memory before the pixel data is read from the second address of the frame memory.

2. A graphics system according to claim 1, wherein:

each of the plurality of addresses has a total bit length and is formed of first bits having a first bit length and second bits having a second bit length; and the detector is configured to only compare the second bits of the detected second address with the second bits of the detected first address to identify an overlap of the first graphic object and the second graphic object.

3. A graphics system according to claim 2, wherein the detector is configured to detect the first address by detecting only the second bits of the first address and to detect the second address by detecting only the second bits of the second address.

4. A graphics system according to claim 2, wherein:

the sum of the first bit length and the second bit length equals the total bit length; and the first bit length is greater than the second bit length.

5. A graphics system according to claim 1, wherein:

the first address and the second address are associated with a single page of the graphic images;

the detector includes an address memory configured to store the detected first address; and the address memory is cleared of the detected first address responsive to the detector detecting a request to read the pixel data associated with another page of the graphic images.

6. A graphics system according to claim 5, wherein the address memory is a content addressable memory and the frame memory includes a synchronous dynamic random access memory.

7. A graphics controller for storing graphic images represented by digital data, comprising:

a frame memory configured to store, at a plurality of addresses, pixel data representing a first page of graphic images and a second page of graphic images, each of the plurality of addresses being associated with one or more of a plurality of graphic fragments forming the first page graphic images and the second page graphic images;

a memory controller configured to control writing of the pixel data to the frame memory, and reading of the pixel data stored in the frame memory;

an address detector configured to detect a first address associated with the first page graphic images responsive to a request to read the pixel data from the first address, to store the detected first address in an address memory, to detect a subsequent request to read the pixel data from a second address associated with the second page graphic images, and to clear the address memory of the detected first address responsive to detection of the subsequent request to read the pixel data from the second address.

8. A graphics controller according to claim 7, wherein the detector is configured to store only a portion of a total number of bits forming the first address in the address memory and to fully clear the address memory responsive to detection of the subsequent request to read the pixel data from the second address.

9. A graphics controller according to claim 7, wherein the address memory is a content addressable memory and the frame memory includes a synchronous dynamic random access memory.

10. A method for processing graphic images represented by digital data, comprising the steps of:

storing, at a plurality of addresses, pixel data representing graphic images including a first graphic object and a second graphic object, each of the plurality of addresses being associated with one or more of a plurality of graphic fragments forming the first graphic object and the second graphic object, and a first of the plurality of addresses being associated with those of the plurality of graphic fragments forming the first graphic object and a second of the plurality of addresses being associated with those of the plurality of graphic fragments forming the second graphic object;

detecting the first address responsive to a request to read the pixel data from the first address;

detecting the second address responsive to a subsequent request to read pixel data from the second address;

comparing the detected second address with the detected first address to identify an overlap of the first graphic object and the second graphic object if the first address and the second address are identical; and writing the pixel data read from the first address of the frame memory before reading the subsequently requested pixel data from the second address of the frame memory if an overlap is identified.

11. A method for processing graphic images according to claim 10, further comprising the step of:

modifying the associated fragment with the pixel data read from the first address so as to form modified pixel data; and wherein the pixel data written to the frame memory is the modified pixel data.

12. A method for processing graphic images according to claim 10, wherein:

each of the plurality of addresses has a total bit length and is formed of first bits having a first bit length and second bits having a second bit length; and only the second bits of the detected first and the detected second addresses are compared to identify an overlap.

13. A method for processing graphic images according to claim 12, wherein only the second bits of the first and the second addresses are detected.

14. A method for processing graphic images according to claim 12, wherein:

the sum of the first bit length and the second bit length equals the total bit length; and the first bit length is greater than the second bit length.

15. A method for processing graphic images according to claim 10, wherein the first address and the second address are associated with a single page of the graphic images and further comprising the steps of:

storing the detected first and the detected second addresses in an address memory;

requesting a read of the pixel data associated with another page of the graphic images; and clearing the detected first and the detected second addresses from the address memory responsive to the request to read the pixel data associated with the another page of the graphic images.

16. A process for storing graphic images represented by digital data, comprising the steps of:

storing, at a plurality of addresses, pixel data representing a first page of the graphic images and a second page of the graphic images, each of the plurality of addresses being associated with one or more of a plurality of graphic fragments forming the first page graphic images and the second page graphic images;

detecting a first address associated with the first page graphic images;

storing the detected first address in an address memory;

detecting a subsequent request to read the pixel data from a second address associated with the second page graphic images;

clearing the address memory of the detected first address responsive to detecting the subsequent request.

17. A process for storing graphic images according to claim 16, wherein only the selected bits of the detected first address are stored in the address memory.

18. A process for storing graphic images according to claim 16, wherein the address memory is a content addressable memory.

19. A graphics system for storing and editing graphic images represented by digital data, comprising:

a frame memory configured to store, at a plurality of addresses, pixel data representing graphic images including graphic images associated with a first page of graphic images, having a first graphic object and a second graphic object, and graphic images associated with a second page of graphic images having a third graphic object, each of the plurality of addresses being associated with one or more of a plurality of graphic fragments forming graphic objects of the first and the second page graphic images, and a first of the plurality of addresses being associated with a first of the plurality of graphic fragments forming the first graphic object, a second of the plurality of addresses being associated with a second of the plurality of graphic fragments forming the second graphic object and a third of the plurality of addresses being associated with a third of the plurality of graphic fragments forming the third graphic object;

a memory controller configured to control writing of the pixel data to the frame memory and reading of the pixel data stored in the frame memory;

a fragment editor configured to receive the pixel data read from the frame memory and to modify the associated fragment with the received pixel data to form modified pixel data; and an address detector, having an address memory, configured to detect memory addresses responsive to a request to read the pixel data from the addresses, to store the detected addresses in the address memory, and to compare the stored addresses with a subsequently detected address to determine (i) if the first graphic object and the second graphic object overlap and (ii) if the stored addresses are associated with one of the first and the second page graphic images and the subsequently detected address is associated with the other of the first and the second page graphic images.

20. A graphics system for storing and editing graphic images in accordance to claim 19, wherein the address memory is cleared of the stored addresses responsive to the detector determining one of (i) the overlap and (ii) the subsequently detected address is associated with said other page graphic images.

21. A graphics system for storing and editing graphic images in accordance to claim 19, wherein the pixel data read from the stored addresses is written in the frame memory prior to reading the pixel data from the subsequently detected address responsive to the detector determining one of (i) the overlap and (ii) the subsequently detected address is associated with said other page graphic images.

22. A graphics system for storing graphic images represented by digital data, comprising:

a frame memory configured to store, at a plurality of addresses, pixel data representing graphic images, each of the plurality of addresses being associated with one or more of a plurality of graphic fragments;

a memory controller configured to control writing of the pixel data to the frame memory and reading of the pixel data stored in the frame memory; and an address detector, having an address memory, configured to detect frame memory addresses responsive to requests to perform at least one of reading of pixel data from and writing of pixel data to the frame memory addresses and to store the detected addresses in the address memory;

wherein the address memory is completely cleared responsive to a current request to perform at least one of a reading of pixel data from and a writing of pixel data to the frame memory addresses if one of (i) the address memory is full, (ii) the frame memory address detected responsive to the current request matches one of the stored addresses, and (iii) the stored addresses are associated with a first page of graphic images and the frame memory address detected responsive to the current request is associated with a second page of graphic images.

23. A graphics system for storing graphic images according to claim 22, further comprising:

a read queue for receiving the current request from the address detector; and a write queue for writing pixel data to the frame memory;

wherein the address detector tags the current request if one of (i) the address memory is full, (ii) the frame memory address detected responsive to the current request matches one of the stored addresses, and (iii) the stored addresses are associated with a first page of graphic images and the frame memory address detected responsive to the current request is associated with a second page of graphic images, and wherein the memory controller is configured to control writing of pixel data to the frame memory responsive to all requests in the write queue prior to reading of the pixel data from the frame memory responsive to a tagged request in the read queue.

* * * * *